United States Patent [19]

Lawrence et al.

[11] 4,340,755

[45] Jul. 20, 1982

[54] BIGUANIDE DIPERCHLORATE AND PROCESS FOR PREPARATION THEREOF

[75] Inventors: Gail W. Lawrence; Horst G. Adolph, both of Silver Spring, Md.

[73] Assignee: The United States of America as represented by the Secretary of the Navy, Washington, D.C.

[21] Appl. No.: 195,991

[22] Filed: Oct. 10, 1980

[51] Int. Cl.[3] ..... C07C 129/16

[52] U.S. Cl. ..... 564/233; 149/75

[58] Field of Search ..... 149/75; 564/233

[56] References Cited

U.S. PATENT DOCUMENTS 2,334,151 11/1943 Thurston ..... 564/233

3,864,177 2/1975 Klunsch et al. ..... 149/75

OTHER PUBLICATIONS

Kawano et al., Chem. Abs., vol. 59, p. 3770 (1963).

Kodama et al., Chem. Abs., vol. 83, 16601x, p. 117 (1975).

Pinkerton et al., Chem. Abs., vol. 90, 64792a, p. 661 (1979).

*Primary Examiner*—Leland A. Sebastian

[57] ABSTRACT

Biguanide diperchlorate,

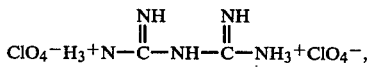

is prepared by the reaction of 1 mole of biguanide with 2 moles of perchloric acid at a temperature of from 0° to 20° C. Biguanide diperchlorate is an explosive which combines good impact sensitivity, high energy output, and good thermal stability.

2 Claims, No Drawings

BIGUANIDE DIPERCHLORATE AND PROCESS FOR PREPARATION THEREOF

BACKGROUND OF THE INVENTION

This invention relates to explosives and more particularly to explosives which are perchlorate salts of organic compounds.

Pentaerythritol Tetranitrate (PETN) is widely used in detonation transfer devices because of the combination of high sensitivity or easy initiability and its high explosive output. However, it suffers from the disadvantage of having relatively poor thermal stability, aging characteristics, and lack of compatibility with other explosive ingredients. Therefore, a replacement for PETN is desirable for some of its applications.

SUMMARY OF THE INVENTION

Accordingly, it is an object of this invention to provide a new explosive compound.

Another object of this invention is to provide a method of synthesizing a new organic compound.

A further object of this invention is to provide an explosive having good impact sensitivity.

Yet another object of this invention is to provide an explosive with good thermal stability.

These and other objectives of this invention are achieved by providing biguanide diperchlorate,

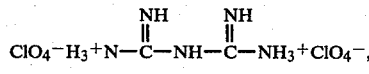

which can be prepared by reacting 2 moles of perchloric acid with 1 mole of biguanide while maintaining the reaction temperature in the range of from 0° C. to 20° C.

DETAILED DESCRIPTION OF THE PREFERRED EMBODIMENT

Biguanide diperchlorate,

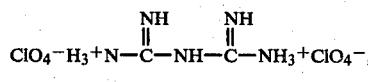

is a new explosive compound having good impact sensitivity combined with excellent thermal stability. The data in Table 1 illustrates this.

TABLE 1

| | Impact Sensitivity | Thermal Stability | $\rho_o$ (g/cm$^3$) | m.p. | D* (km/sec) | $P_J$* (Kbar) |
|---|---|---|---|---|---|---|
| PETN | 10–11 | 2.2 (120°) (40 hr) | 1.78 | 139–42 | 8680 | 334 |
| Biguanide Diperchlorate | 11.8 | 0.20 (140° C.) (48 hr) | 1.91 | 217–219° C. | 8490 | 328 |
| RDX | 14.9 | 1.11 (150° C.) (48 hr) | 1.80 | 205 | 8754 | 343 |

*Calculated by KSM

The impact sensitivity of biguanide diperchlorate is comparable to that of Pentaerythritol Tetranitrate (PETN) and the thermal stability is much greater for biguanide diperchlorate.

Melt-castable mixtures of ammonium nitrate and ethylenediamine dinitrate or ammonium dinitrotriazole are useful as casting media for a variety of explosives, for example 1,3,5-triamino-2,4,6-trinitrobenzene (TATB) and other insensitive high explosives. Because of the insensitivity of all ingredients of such compositions, very large failure diameters result for these explosives. The failure diameter can be reduced by the addition of biguanide diperchlorate which acts as a sensitizer. Biguanide diperchlorate may also be used in detonation transfer devices as a replacement for PETN.

Biguanide diperchlorate is made by reacting two moles of perchloric acid with one mole of biguanide. The reaction temperature is kept at from 0° C. to 20° C. by external cooling and by controlling the rate at which the reactants are brought together.

The invention may be more clearly understood by reference to the following examples which are included for purposes of illustrating the preparation of biguanide diperchlorate and are not intended to limit the scope of the invention.

EXAMPLE 1

Biguanide (3.0 g, 101.11 g/mol; $2.96\times10^{-2}$ mol) was added gradually as a solid to perchloric acid (10.3 mol, 5.78 N) in an ice bath. The solution was evaporated under vacuum with a dry ice trap. The white crystals (8.6 g 96.5%) of biguanide diperchlorate were dried under vacuum over $P_2O_5$ and KOH.

Concentration of a saturated ethyl acetate/acetonitrile solution gave crystals, mp 217°–219° C.

EXAMPLE 2

Free biguanide (6.0 g, $5.93\times10^{-2}$ moles) dissolved in absolute ethanol (100 ml) was cooled in an ice bath to 5° C., whereupon some of the biguanide crystallized out. Perchloric acid (17.03 g, 70%, $1.19\times10^{-1}$ moles, 2 eq) dissolved in absolute ethanol (20 ml) was added dropwise. When the addition was about a third complete, the crystallized portion redissolved. During the addition the temperature was maintained between 5° and 20° C. The addition required 1.5 hours. Then ethyl acetate (100 ml) was added. This solution was rotary evaporated almost to dryness. Then 50 ml of ethyl acetate was added. This mixture was concentrated almost to dryness. This process was repeated. The white solid was washed with ethyl acetate and then filtered and dried at room temperature over KOH—$P_2O_5$ under vacuum overnight. Yield: 16.40 g, 91%, mp 217°–219° C.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. Biguanide diperchlorate.

2. A process for synthesizing biguanide diperchlorate comprising:

(1) slowly combining an alcoholic solution of perchloric acid, $HClO_4$, with an alcoholic solution of biguanide while the temperature of the resulting mixture is maintained at a temperature from 0° to less than 20°, wherein two equivalents of perchloric acid are used for each equivalent of biguanide, and (2) isolating the product biguanide perchlorate.

* * * * *